US007861565B2

(12) United States Patent
Saito et al.

(10) Patent No.: US 7,861,565 B2
(45) Date of Patent: Jan. 4, 2011

(54) METHOD FOR APPLYING LUBRICANT ONTO MANDREL BAR, METHOD FOR CONTROLLING THICKNESS OF LUBRICANT FILM ON MANDREL BAR, AND METHOD FOR MANUFACTURING SEAMLESS STEEL PIPE

(75) Inventors: Kenichi Saito, Wakayama (JP); Sumio Iida, Kawasaki (JP)

(73) Assignee: Sumitomo Metal Industries, Ltd., Osaka-shi (JP)

( * ) Notice: Subject to any disclaimer, the term of this patent is extended or adjusted under 35 U.S.C. 154(b) by 0 days.

(21) Appl. No.: 12/482,288

(22) Filed: Jun. 10, 2009

(65) Prior Publication Data

US 2009/0293569 A1 Dec. 3, 2009

Related U.S. Application Data

(63) Continuation of application No. PCT/JP2007/075119, filed on Dec. 27, 2007.

(30) Foreign Application Priority Data

Dec. 28, 2006 (JP) ..... 2006-354658

(51) Int. Cl.
*B21B 45/02* (2006.01)

(52) U.S. Cl. ..... 72/42; 72/208; 72/236

(58) Field of Classification Search ..... 72/41, 72/42, 43, 44, 97, 208, 209, 236; 73/10
See application file for complete search history.

(56) References Cited

U.S. PATENT DOCUMENTS 4,253,326 A * 3/1981 Munnich et al. ..... 73/10
4,711,733 A * 12/1987 Kanda et al. ..... 508/118
5,983,689 A * 11/1999 Yorifuji et al. ..... 72/42
6,432,886 B1 * 8/2002 Reidmeyer ..... 508/114
7,308,812 B2 * 12/2007 Iida et al. ..... 72/42

FOREIGN PATENT DOCUMENTS

| | | | |
|---|---|---|---|
| JP | 64-016894 | | 1/1989 |
| JP | 3-210905 | | 9/1991 |
| JP | 5-171165 | | 7/1993 |
| JP | 8-165489 | * | 6/1996 |
| JP | 9-78080 | | 3/1997 |
| JP | 2003-313573 | * | 11/2003 |
| JP | 2005-097605 | | 4/2005 |

OTHER PUBLICATIONS

International Search Report dated Apr. 1, 2008 in corresponding PCT/JP2007/075119 (English and Japanese versions).
Written Opinion Apr. 1, 2008 in corresponding PCT/JP2007/075119 (Japanese only).
International Preliminary Examination Report in corresponding PCT/JP/2007/075119 dated Jul. 7, 2009.
English Translation of Written Opinion of Apr. 1, 2008.

* cited by examiner

*Primary Examiner*—Edward Tolan
(74) *Attorney, Agent, or Firm*—Marshall, Gerstein & Borun LLP

(57) ABSTRACT

In applying a non-graphite-based lubricant composed of, by mass %, 10 to 70% of an oxide-based lamellar compound and 30 to 90% of boric acid onto a mandrel bar, the lubricant film thickness is set from a predetermined master curve for the lubricant film thickness corresponding to an amount of mica. This stably produces a seamless steel pipe of high quality, while preventing seizing marks and internal flaws.

5 Claims, 1 Drawing Sheet

METHOD FOR APPLYING LUBRICANT ONTO MANDREL BAR, METHOD FOR CONTROLLING THICKNESS OF LUBRICANT FILM ON MANDREL BAR, AND METHOD FOR MANUFACTURING SEAMLESS STEEL PIPE

The disclosure of International Application No. PCT/JP2007/075119 filed Dec. 27, 2007 including specification, drawings and claims is incorporated herein by reference in its entirety.

1. Technical Field

The present invention relates to a method for applying a lubricant onto a mandrel bar used for manufacturing a seamless steel pipe, particularly a seamless steel pipe made of stainless steel, a method for controlling thickness of a lubricant film on a mandrel bar, and a method for manufacturing a seamless steel pipe.

2. Background Art

Friction conditions in hot piping of seamless steel pipes are generally severe. In particular, usable lubricants are limited since the surface temperature of a mandrel bar is high. Hence, a graphite-based lubricant that inorganic materials such as salt are mixed in powdery graphite, has been conventionally used. However, at present, in order to deal with the carburization of processed materials and the deterioration of working environments, various non-graphite-based lubricants have been used.

For example, the applicant discloses in patent document 1, an invention related to a hot working solid lubricant made of 10 parts by weight of at least one particular oxide-based lamellar substance selected from potassium tetrasilicate mica, sodium tetrasilicate mica, natural gold mica, bentonite, and vermiculite, and 1 to 5 parts by weight of at least one binder selected from boron oxide, boric acid, and alkali metal borate.

In addition, the applicant discloses in patent document 2, an invention related to a lubricant composition for processing a seamless steel pipe, wherein the lubricant composition is made of 10 to 40% by mass of an oxide-based lamellar compound, 5 to 30% by mass of at least one selected from alkali metal borate and amine salt, and 0.11 to 3.0% by mass of at least one water-soluble polymer that is soluble in an aqueous solution of at least one selected from alkali metal borate and amine salt, with the balance being water.

[Patent document 1] JP S64-16894A

[Patent document 2] JP 2005-97605A

DISCLOSURE OF THE INVENTION

Problems to be Solved by the Invention

Since the inventions described in patent documents 1 and 2 are concerned with non-graphite-based lubricants, the above problems encountered in the graphite based lubricants can be solved. However, in the case where the adhesion amount of the lubricant is small, that is, in the case where the thickness of the lubricant film is thin, seizing marks might occur on the inner surface of a product. In a case where the adhesion amount of a lubricant is large an oxide-based lamellar compound will not burn. That is, in the case where the thickness of a lubricant film is thick, the lubricant precipitates on the bar surface, through repeated rolling, generates grazes on the inner surface of a product. Therefore, it is necessary to set the adhesion amount of the lubricant within a suitable range, in addition to adjusting the composition of the lubricant; otherwise a seamless steel pipe with high quality cannot be stably obtained.

The present inventors conducted an extensive study with such circumstances in mind, and as a result, have found that there is a certain corresponding relationship between the amount of mica and the thickness of a lubricant film applied onto a mandrel bar, respecting the problem of the above-described seizing marks and internal flaws, and have completed the present invention accordingly.

It is an objective of the present invention to provide a method for applying a lubricant onto a mandrel bar capable of stably obtaining a seamless steel pipe with high quality by preventing seizing marks and internal flaws through control of the amount of mica and the thickness of the lubricant film applied on the mandrel bar. This method controls the thickness of the lubricant film on the mandrel bar, and also is the method for manufacturing the seamless steel pipe.

Means to Solve the Problems

The present invention is summarized as (A) a method for applying a lubricant onto a mandrel bar, (B) a method for controlling a thickness of a lubricant film on a mandrel bar, and (C) a method for manufacturing a seamless steel pipe.

(A) A method for applying a non-graphite-based lubricant composed of, by mass %, 10 to 70% of an oxide-based lamellar compound and 30 to 90% of boric acid onto a mandrel bar, characterized by setting the lubricant film thickness from a predetermined master curve for the lubricant film thickness corresponding to an amount of mica.

The above master curve is preferably in a range satisfying the following formulas (1) and (2):

$$t \leqq -54\ ln(q)+324 \quad (1)$$

$$t \geqq -28\ ln(q)+124 \quad (2)$$

where t denotes the lubricant film thickness (mm) and q denotes the amount (%) of mica of the lubricant.

The lubricant film thickness may be adjusted by the discharge condition of the lubricant and the bar-sending speed.

(B) A method for controlling the thickness of the lubricant film on the mandrel bar, characterized by comprising steps of determining the amount of mica of the lubricant and applying the lubricant by adjusting the discharge condition of the lubricant and/or a bar-sending speed in order to make the lubricant film thickness correspond to the amount of mica according to (A), measuring an actual lubricant film thickness, and then adjusting the discharge condition of the lubricant and/or the bar-sending speed in accordance with the measurement.

(C) A method for manufacturing a seamless steel pipe by using a mandrel bar with a lubricant applied thereon by the method according to (A).

This method for manufacturing a seamless steel pipe is particularly suitable for manufacturing a seamless steel pipe made of stainless steel.

Effect of the Invention

Controlling the amount of mica of a lubricant applied on a mandrel bar and the lubricant film thickness in accordance with the present invention which stably realizes a seamless steel pipe with high quality, preventing seizing marks and internal flaws. The present invention is particularly useful for manufacturing a seamless steel pipe made of stainless steel.

BEST MODE FOR CARRYING OUT THE INVENTION

Figure 1:
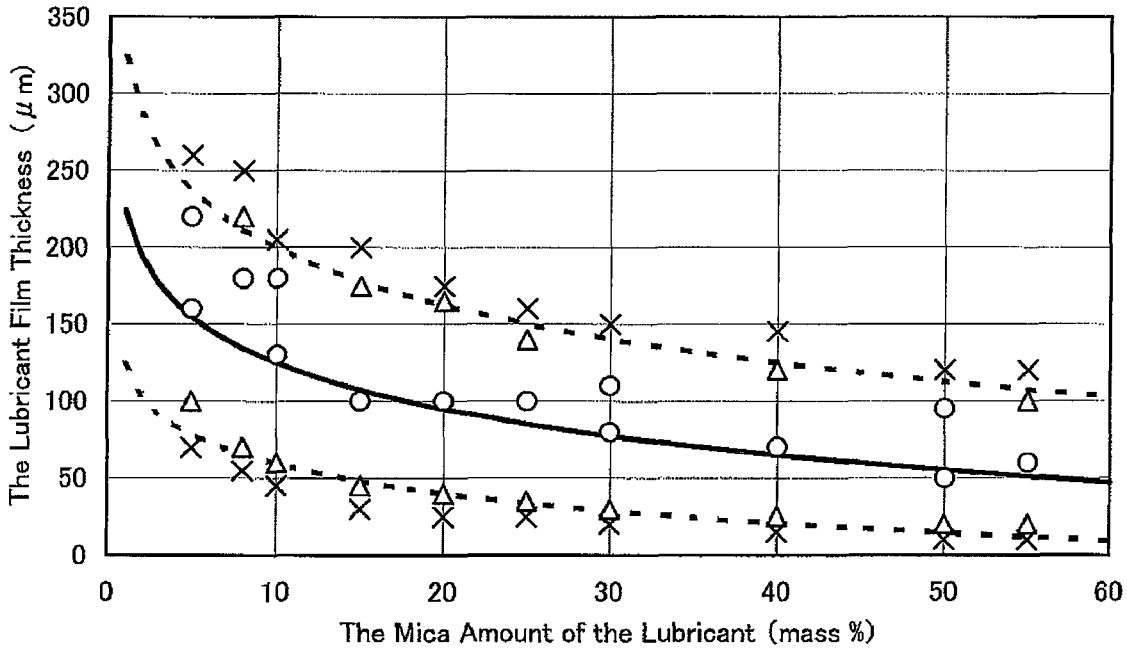
FIG. 1 is an organized diagram of a lubricant film thickness against the amount of mica on the basis of evaluation.

In the method for applying a lubricant onto a mandrel bar according to the present invention, a non-graphite-based lubricant composed of, by mass %, 10 to 70% of an oxide-based lamellar compound and 30 to 90% of boric acid is used.

The above-described oxide-based lamellar compound is for example, natural or artificial mica. Examples of the mica include potassium tetrasilicate $\{KMg_2.5(Si_4O_{10})F_2\}$, sodium tetrasilicate $\{NaMg_2.\ 5(Si_4O_{10})F_2\}$, and natural gold mica $\{KMg_3(AlSi_2O_{10})(OH)_2\}$. At least one of the above compounds can be used as the oxide-based lamellar compound. In place of mica or together with mica, it is possible to use vermiculite, bentonite, or the like. Sodium tetra silicate mica is most preferable.

When the content of the oxide-based lamellar compound in the composition is too small, seizure resistance tends to decrease and a problem arises with lubricity. On the other hand, when the content of the oxide-based lamellar compound is too large, the viscosity of the composition becomes too high, causing a problem with workability. Therefore, the content of the oxide-based lamellar compound in the composition was set to 10 to 70 mass %. A lower limit is preferably 15 mass %. An upper limit is preferably 50 mass %.

While the average particle diameter of the oxide-based lamellar compound is not particularly limited, 1 to 40 μm is desirable, and 5 to 30 μm is more desirable. This is due to the interlayer sliding effect becoming smaller when the average particle diameter is too small, on the other hand problems might occur including nozzle clogging during spraying when the average particle diameter is too large.

The boric acid in the composition assists spreadability on a mandrel bar of high temperature along the oxide-based lamellar compound serving as a base compound, and also acts as an auxiliary lubricant. The boric acid is contained in the form of alkali metal salt such as lithium borate, sodium borate, and potassium borate. Metaborate or pyroborate, or a hydrate of these such as borax ($Na_2B_40_7.10\ H_2O$) may be used.

The lubricity of the base compound is compromised when the content of boric acid is too large, while the spreadability on a mandrel bar deteriorates, resulting in a lack of lubricability when the content of boric acid is too small. Therefore, the content of boric acid in the composition was set to 30 to 90 mass %. A lower limit is preferably set 30 mass %. An upper limit is preferably set 70 mass %.

EXAMPLES

According to the present invention, the above-described non-graphite-based lubricant applied onto a mandrel bar. The thickness of the lubricant film is determined from a predetermined master curve of the amount of mica and the film thickness of the lubricant. The present inventors carried out the following experiments in regard to the corresponding relationship between the amount of mica and the lubricant film thickness.

First, potassium tetrasilicate mica $\{KMg_2.5(Si_4O_{10})F_2\}$ and sodium tetrasilicate mica $\{NaMg_2.5(Si_4O_{10})F_2\}$ were used as oxide-based lamellar compounds, which were then mixed with various amounts of boric acid to prepare the lubricants with different amounts of mica.

The lubricant was applied onto a mandrel bar. The lubricant film thickness was adjusted by discharge conditions such as the discharge pressure of the lubricant, nozzle diameter, and also viscosity of the lubricant, and the bar-sending speed. Seamless steel pipes of stainless steel were produced using mandrel bars with various lubricants applied thereon and subjected to an examination for the presence of seizure and for presence of grazes on the inner surface of products at first pass, fifth pass and tenth pass. These conditions are shown in Table 1.

[Table 1]

TABLE 1

| Chemical Composition (mass %, balance being boric acid) | | Thickness of | Result of the Examination | | | | |
|---|---|---|---|---|---|---|---|
| | | | | graze | | | |
| Type of Oxide-based Lamellar Compound | mica amount (mass %) | Lubricant Film (μm) | seizure | 1st. Pass | 5th Pass | 10th Pass | Evaluation |
| potassium tetrasilicate mica | 8 | 250 | ○ | ○ | Δ | X | X |
| | | 220 | ○ | ○ | ○ | Δ | Δ |
| | | 180 | ○ | ○ | ○ | ○ | ○ |
| | | 70 | Δ | ○ | ○ | ○ | Δ |
| | | 55 | X | ○ | ○ | ○ | X |
| | 10 | 205 | ○ | ○ | X | X | X |
| | | 180 | ○ | ○ | ○ | ○ | ○ |
| | | 130 | ○ | ○ | ○ | ○ | ○ |
| | | 60 | Δ | ○ | ○ | ○ | Δ |
| | | 45 | X | ○ | ○ | ○ | X |
| | 20 | 175 | ○ | ○ | Δ | X | X |
| | | 165 | ○ | ○ | ○ | Δ | Δ |
| | | 100 | ○ | ○ | ○ | ○ | ○ |
| | | 40 | Δ | ○ | ○ | ○ | Δ |
| | | 25 | X | ○ | ○ | ○ | X |
| | 40 | 145 | ○ | ○ | X | X | X |
| | | 120 | ○ | ○ | ○ | Δ | Δ |
| | | 70 | ○ | ○ | ○ | ○ | ○ |
| | | 25 | Δ | ○ | ○ | ○ | Δ |
| | | 15 | X | ○ | ○ | ○ | X |

TABLE 1-continued

| Chemical Composition (mass %, balance being boric acid) | | Thickness of | Result of the Examination | | | | |
|---|---|---|---|---|---|---|---|
| | | | | graze | | | |
| Type of Oxide-based Lamellar Compound | mica amount (mass %) | Lubricant Film (μm) | seizure | 1st. Pass | 5th Pass | 10th Pass | Evaluation |
| | 55 | 120 | ○ | ○ | Δ | X | X |
| | | 100 | ○ | ○ | Δ | Δ | Δ |
| | | 60 | ○ | ○ | ○ | ○ | ○ |
| | | 20 | Δ | ○ | ○ | ○ | Δ |
| | | 10 | X | ○ | ○ | ○ | X |
| sodium tetrasilicate mica | 5 | 260 | ○ | ○ | X | X | X |
| | | 220 | ○ | ○ | ○ | ○ | ○ |
| | | 160 | ○ | ○ | ○ | ○ | ○ |
| | | 100 | Δ | ○ | ○ | ○ | Δ |
| | | 70 | X | ○ | ○ | ○ | X |
| | 15 | 200 | ○ | ○ | X | X | X |
| | | 175 | ○ | ○ | Δ | Δ | Δ |
| | | 100 | ○ | ○ | ○ | ○ | ○ |
| | | 45 | Δ | ○ | ○ | ○ | Δ |
| | | 30 | X | ○ | ○ | ○ | X |
| | 25 | 160 | ○ | ○ | Δ | X | X |
| | | 140 | ○ | ○ | Δ | Δ | Δ |
| | | 100 | ○ | ○ | ○ | ○ | ○ |
| | | 35 | Δ | ○ | ○ | ○ | Δ |
| | | 25 | X | ○ | ○ | ○ | X |
| | 30 | 150 | ○ | ○ | Δ | X | X |
| | | 110 | ○ | ○ | ○ | ○ | ○ |
| | | 80 | ○ | ○ | ○ | ○ | ○ |
| | | 30 | Δ | ○ | ○ | ○ | Δ |
| | | 20 | X | ○ | ○ | ○ | X |
| | 50 | 120 | ○ | ○ | X | X | X |
| | | 95 | ○ | ○ | ○ | ○ | ○ |
| | | 50 | ○ | ○ | ○ | ○ | ○ |
| | | 20 | Δ | ○ | ○ | ○ | Δ |
| | | 10 | X | ○ | ○ | ○ | X |

In Table 1, "○" on the "Seizure" column means that no seizure occurred, "Δ" means that partial seizure occurred, and "x" means that seizure occurred.

In Table 1, "○" on the "Graze" column means that no graze occurred, "Δ" means that a small graze of 0.2 mm or less occurred, and "x" means that a graze in excess of 0.2 mm occurred.

In Table 1, "○" on the "Evaluation" column means that both seizure and graze at tenth pass are evaluated "○", "Δ" means that either seizure or graze is evaluated "○", while the other being "Δ", and "x" means that either burn or scar defect is evaluated "x".

FIG. 1 is a diagram that organizes the experimental results shown in Table 1.

For example, Table 1 indicates that if the amount of mica is 5%, unless the lubricant film thickness is limited to the range of approximately 200 to 120 μm (center value: approximately 160 μm), seizure or graze tends to occur, while if the amount of mica is 55%, the lubricant film thickness must be limited to the range of approximately 100 to 20 μm (center value: approximately 60 μm). That is, it is understood that the lubricant film thickness must be changed according to the chemical composition of the lubricant, specifically, the amount of mica.

The present invention has been made after experimental results. Therefore, for example, by preparing a master curve in a desirable range of the lubricant film thickness corresponding to the amounts of mica, it is possible to set the lubricant film thickness in accordance with the amount of mica in the lubricant applied on a mandrel bar.

As a master curve, that is a curve connecting the center values of preferable ranges in FIG. 1, or an approximate curve of the "○" plots in FIG. 1 may be used. Alternatively, in view of variations, an approximate curve within the region defined by "Δ" may be used. In any case, the master curve is desirably determined within a range defined by dotted lines in FIG. 1, that is, within a range satisfying the following formulas (1) and (2):

$$t \leqq -54\ ln(q)+324 \quad (1)$$

$$t \geqq -28\ ln(q)+124 \quad (2)$$

where t denotes the lubricant film thickness (mm) and q denotes the amount (%) of mica of the lubricant.

As a master curve, for example, a curve expressed by a solid line in FIG. 1, that is, a curve satisfying the following formula (a) can be used. Alternatively, in view of variations, the master curve may be controlled within a range of the following formula (b). As C in the formula (b), a value of 40 or less is suitable, preferably 20, and more preferably 10.

$$t=-43.222\ ln(q)+224.33 \quad (a)$$

$$t=-43.222\ ln(q)+224.33 \pm C \quad (b)$$

Figure 2:
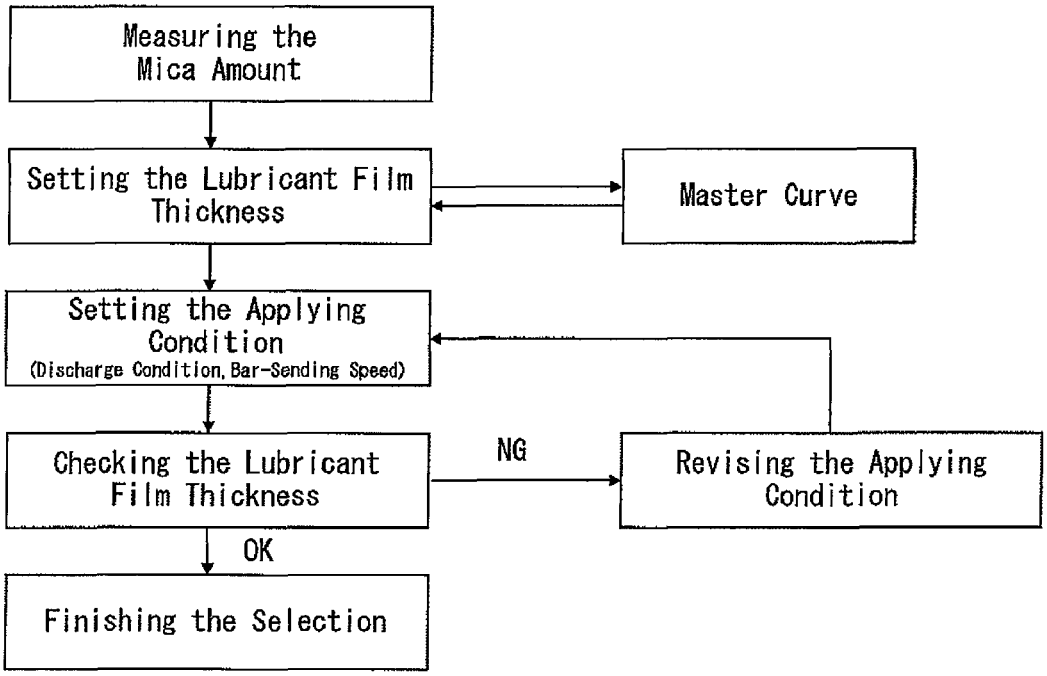
FIG. 2 is a diagram describing a method for controlling the thickness of a lubricant film on a mandrel bar according to the present invention.

FIG. 2 is a diagram describing a method for controlling a lubricant film thickness on a mandrel bar according to the present invention. As shown in FIG. 2, in the actual application of the lubricant onto the mandrel bar, determining the amount of mica of the lubricant, a lubricant film thickness that corresponds to the amount of mica (target a lubricant film thickness) is calculated by using the above-described master curve. Then the lubricant is applied while adjusting the discharge conditions of the lubricant and/or the bar-sending speed, so as to secure the calculated thickness of the lubricant.

After applying the lubricant onto the mandrel bar, the actual lubricant film thickness is measured by a film thickness gauge while the mandrel bar was stopped. When the measured lubricant film thickness is the intended thickness, the lubricant is applied onto the mandrel bar under the same conditions. When the measured lubricant film thickness is not the intended thickness, it is preferable to adjust the discharge conditions of lubricant and/or the bar-sending speed.

Although only some exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

INDUSTRIAL APPLICABILITY

Controlling the amount of mica of a lubricant film applied on a mandrel bar and a lubricant film thickness in accordance with the present invention stably produces a seamless steel pipe of high quality, while preventing seizing marks and internal flaws. The present invention is particularly useful for manufacturing a seamless steel pipe made of stainless steel.

The invention claimed is:

1. A method for applying a non-graphite-based lubricant composed of, by mass %, 10 to 70% of an oxide-based lamellar compound and 30 to 90% of boric acid onto a mandrel bar, characterized by setting the lubricant film thickness from a predetermined master curve which is set in a range satisfying the following formulas (1) and (2):

$$t \leqq -54\ ln(q)+324 \quad (1)$$

$$t \geqq -28\ ln(q)+124 \quad (2)$$

where t denotes the lubricant film thickness (mm) and q denotes the amount (%) of mica of the lubricant.

2. The method for applying a lubricant onto a mandrel bar according to claim 1, wherein the lubricant film thickness is adjusted by a discharge condition of the lubricant and a bar-sending speed.

3. A method for controlling a lubricant film thickness on a mandrel bar, characterized by comprising steps of determining the amount of mica of the lubricant, applying the lubricant by adjusting the discharge condition of the lubricant and/or a bar-sending speed so as to make the lubricant film thickness correspond to the amount of mica by the method according to claim 1, measuring an actual lubricant film thickness, and then adjusting the discharge condition of the lubricant and/or the bar-sending speed in accordance with the measurement.

4. A method for manufacturing a seamless steel pipe by using a mandrel bar with a lubricant applied thereon by the method according to claim 1 or 2.

5. The method for manufacturing a seamless steel pipe according to claim 4, wherein the seamless steel pipe is a seamless steel pipe made of stainless steel.

* * * * *